US011571707B1

(12) United States Patent
Oniszczuk

(10) Patent No.: US 11,571,707 B1
(45) Date of Patent: Feb. 7, 2023

(54) END-MASKING DEVICE

(71) Applicant: Engineered Products and Services, Inc., Franksville, WI (US)

(72) Inventor: Andrew W. Oniszczuk, Pleasant Prairie, WI (US)

(73) Assignee: ENGINEERED PRODUCTS AND SERVICES, INC., Franksville, WI (US)

( * ) Notice: Subject to any disclaimer, the term of this patent is extended or adjusted under 35 U.S.C. 154(b) by 0 days.

(21) Appl. No.: 17/404,516

(22) Filed: Aug. 17, 2021

(51) Int. Cl.
*B05C 21/00* (2006.01)

(52) U.S. Cl.
CPC ..... *B05C 21/005* (2013.01)

(58) Field of Classification Search
None
See application file for complete search history.

(56) References Cited

U.S. PATENT DOCUMENTS 2,388,835 A * 11/1945 James ..... B05B 12/20 118/505
4,879,158 A * 11/1989 Horiki ..... B05B 12/26 118/504
5,514,118 A * 5/1996 Kummer ..... A61F 9/0008 604/289
5,720,330 A * 2/1998 Schmalz, Jr. ..... B01L 3/0213 222/206
10,982,799 B2 * 4/2021 Kessel ..... H02G 3/088
D932,010 S * 9/2021 Schumaier ..... D24/147
2004/0056039 A1 * 3/2004 Sarajian ..... B05B 12/26 220/DIG. 19
2011/0247551 A1 * 10/2011 Malone ..... B05C 21/005 118/505
2014/0366800 A1 * 12/2014 Malone ..... B05B 12/26 118/505
2018/0356013 A1 * 12/2018 Kessel ..... A62C 4/00

OTHER PUBLICATIONS

EPSI, "Cone Series—EPDM Cone Caps" <https://www.epsi.com/cone-series-epdm-cone-caps> web page visited Nov. 15, 2021 (2 pages).
EPSI, "Cons Series—Silicone Cons Caps" <https://www.epsi.com/cons-series-silicone-cons-caps> web page visited Nov. 15, 2021 (2 pages).

(Continued)

*Primary Examiner* — Jethro M. Pence
(74) *Attorney, Agent, or Firm* — Michael Best & Friedrich LLP

(57) ABSTRACT

A masking device for placement over an end of a work piece includes a head portion, a collar portion, and at least one pull tab. The head portion includes a closed end and an interior cavity defined in the head portion. The collar portion is coupled to the head portion opposite the closed end of the head portion. The collar portion includes a radially inner surface defining an opening. The opening is in fluid communication with the interior cavity of the head portion. The opening is narrower than the interior cavity of the head portion. The collar portion further includes a radially outer surface. The at least one pull tab is coupled to the radially outer surface of the collar portion.

12 Claims, 8 Drawing Sheets

(56) References Cited

OTHER PUBLICATIONS

EPSI, "EC Series—EPDM Caps" <https://www.epsi.com/ec-series-epdm-caps> web page visited Nov. 15, 2021 (2 pages).
EPSI, "Ezy Series—Easy Caps" <https://www.epsi.com/ezy-series-easy-caps> web page visited Nov. 15, 2021 (2 pages).
EPSI, "FCS Series—Flanged Caps" <https://www.epsi.com/fcs-series-flanged-caps> web page visited Nov. 15, 2021 (2 pages).
EPSI, "FSC Series—Flat Silicone Caps" <https://www.epsi.com/fsc-series-flat-silicone-caps> web page visited Nov. 15, 2021 (2 pages).
EPSI, "REC Series—Rectangular Caps" <https://www.epsi.com/rec-series-rectangular-caps> web page visited Nov. 15, 2021 (2 pages).
EPSI, "SC Series—Silicone Caps" <https://www.epsi.com/sc-series-silicone-caps> web page visited Nov. 15, 2021 (2 pages).
EPSI, "TCP Series Pro-Tite Tapered Cap and Plug" <https://www.epsi.com/tcp> web page visited Nov. 15, 2021 (6 pages).
EPSI, "VC Series—Vinyl Caps" <https://www.epsi.com/vinylcaps> web page visited Nov. 15, 2021 (3 pages).
EPSI, "WC Series—Washer Caps" <https://www.epsi.com/wc-series-washer-caps> web page visited Nov. 15, 2021 (2 pages).

* cited by examiner

END-MASKING DEVICE

BACKGROUND

The present disclosure relates to masking devices, and more particularly, to a masking devices configured to mask the end of a work piece.

Masking is often used in tandem with the painting or coating of parts used in the automotive, aerospace, electronics, and other industries. The painting or coating of parts may involve liquid coating, plating, powder coating, or electroplating. The coating may be applied by a variety of methods including brushing, rolling, spraying, dipping, flow-coating, electro-static coating, and submersion in deposition tanks. The liquid, powder, or plating material may be applied to wood, fiberglass, or metal surfaces in order to protect and strengthen those surfaces. The coating protects the surface of a part by preventing electrical leakage, oxidation, corrosion and decay. The cured coating forms a very strong protective layer on the surface that is highly resistant to scratching and chipping.

In most applications, a protective coating is applied to only specific areas of a surface. The areas which will not receive the coating must be covered or masked off. Typically, masking tape is applied to the surface areas to be masked. The masking tape generally has an adhesive on one side so that it may be affixed to the surface to be masked. Once the painting or coating process has been completed, the masking tape is removed from the surface.

SUMMARY

In one aspect, the disclosure provides a masking device for placement over an end of a work piece. The masking device includes a head portion, a collar portion, and at least one pull tab. The head portion includes a closed end and an interior cavity defined in the head portion. The collar portion is coupled to the head portion opposite the closed end of the head portion. The collar portion includes a radially inner surface defining an opening. The opening is in fluid communication with the interior cavity of the head portion. The opening is narrower than the interior cavity of the head portion. The collar portion further includes a radially outer surface. The at least one pull tab is coupled to the radially outer surface of the collar portion.

In another aspect, the disclosure provides a masking device for placement over an end of a work piece. The masking device includes a head portion and a collar portion. The head portion includes a closed end and an interior cavity defined in the head portion. The collar portion is coupled to the head portion opposite the closed end of the head portion. The collar portion includes a radially inner surface defining an opening. The opening is in fluid communication with the interior cavity of the head portion. The opening is narrower than the interior cavity of the head portion. The collar portion further includes a radially outer surface. A cross-section of the collar portion is in the shape of a wedge defined between the radially inner surface and the radially outer surface. The widest portion of the wedge is the radially inner surface of the collar portion.

Other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Figure 1:
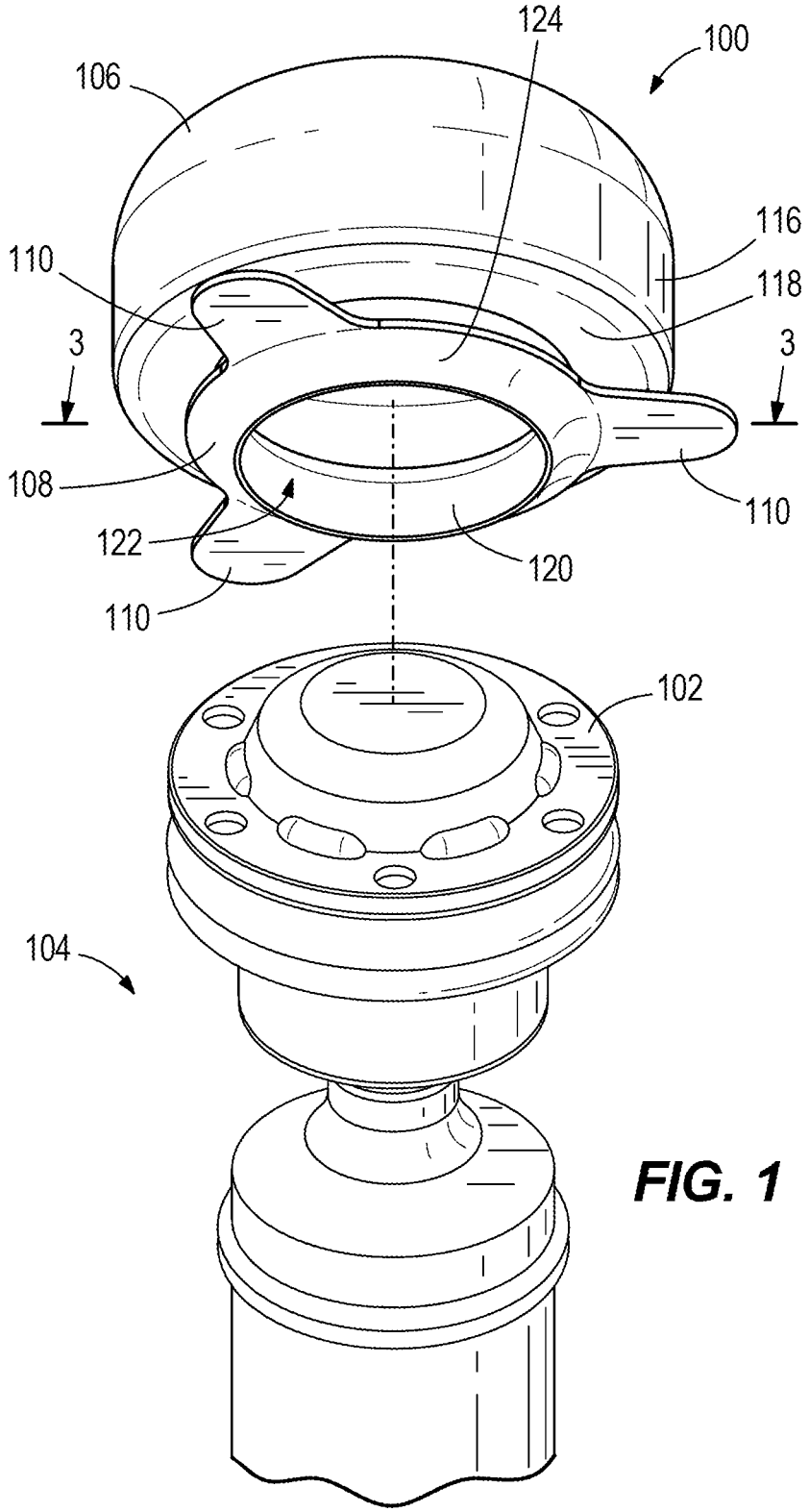
FIG. 1 is a perspective view of a masking device ready to be positioned on a workpiece.
Figure 2:
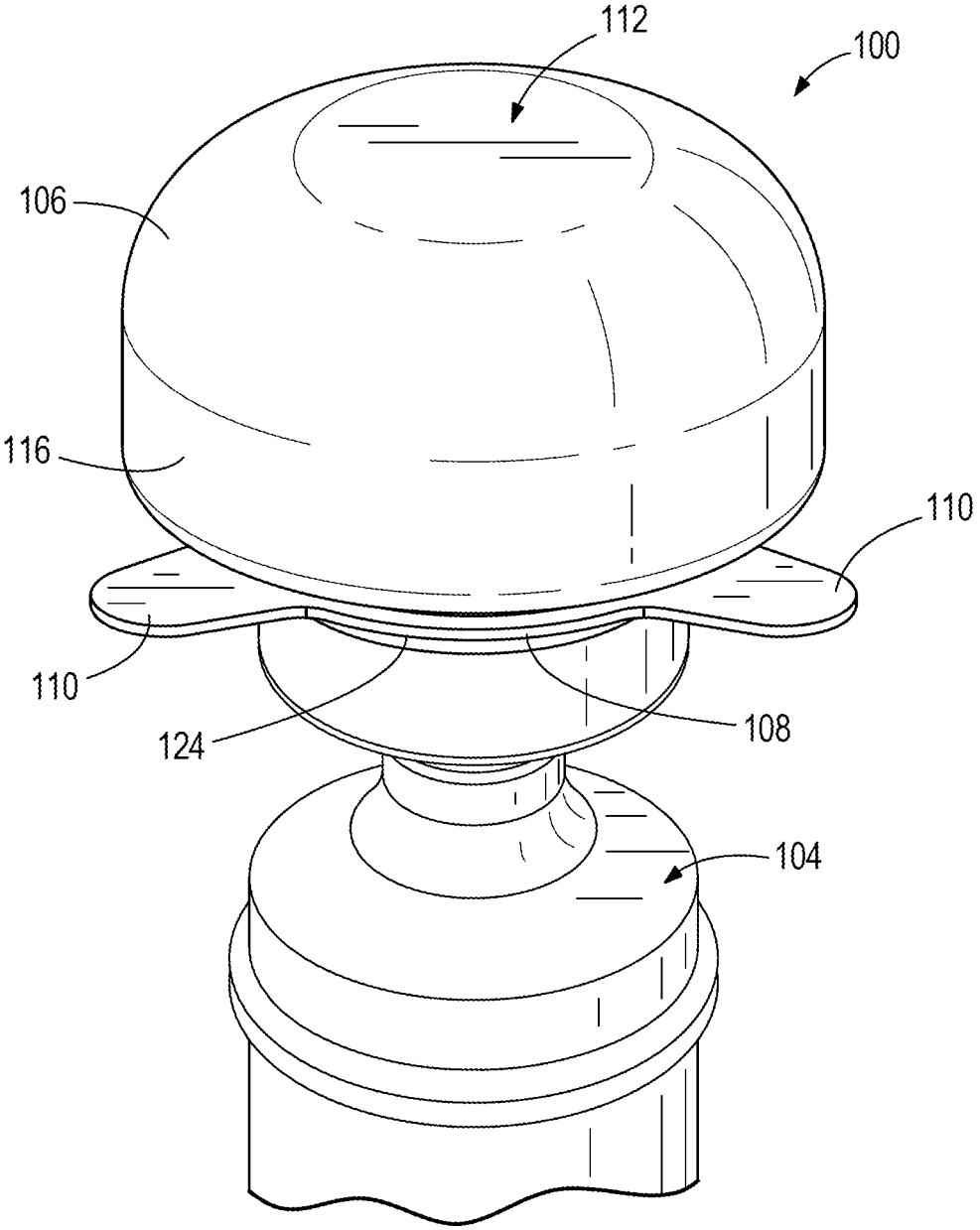
FIG. 2 is a perspective view of the masking device of FIG. 1 positioned on the workpiece.

FIG. 1 illustrates a masking device 100 for covering a masking area, e.g. an end, 102 of a workpiece 104. FIG. 2 illustrates the masking device 100 disposed on at least a portion of the workpiece 104 to cover the masking area 102. In the illustrated example, the workpiece 104 is a driveshaft that is about to undergo a process wash and subsequently a liquid spray application of a rust inhibitor. After application of the rust inhibitor, the workpiece 104 (with the masking device 100 still disposed thereon in some embodiments) is placed in an oven to dry the solvent from the rust inhibiting spray. As such, some embodiments of the masking device 100 are made and/or coated with a heat resistant material, such as silicone rubber or silicone gum. Such materials may have relatively high heat resistance and relatively high elasticity when compared to other masking materials.

Figure 3:
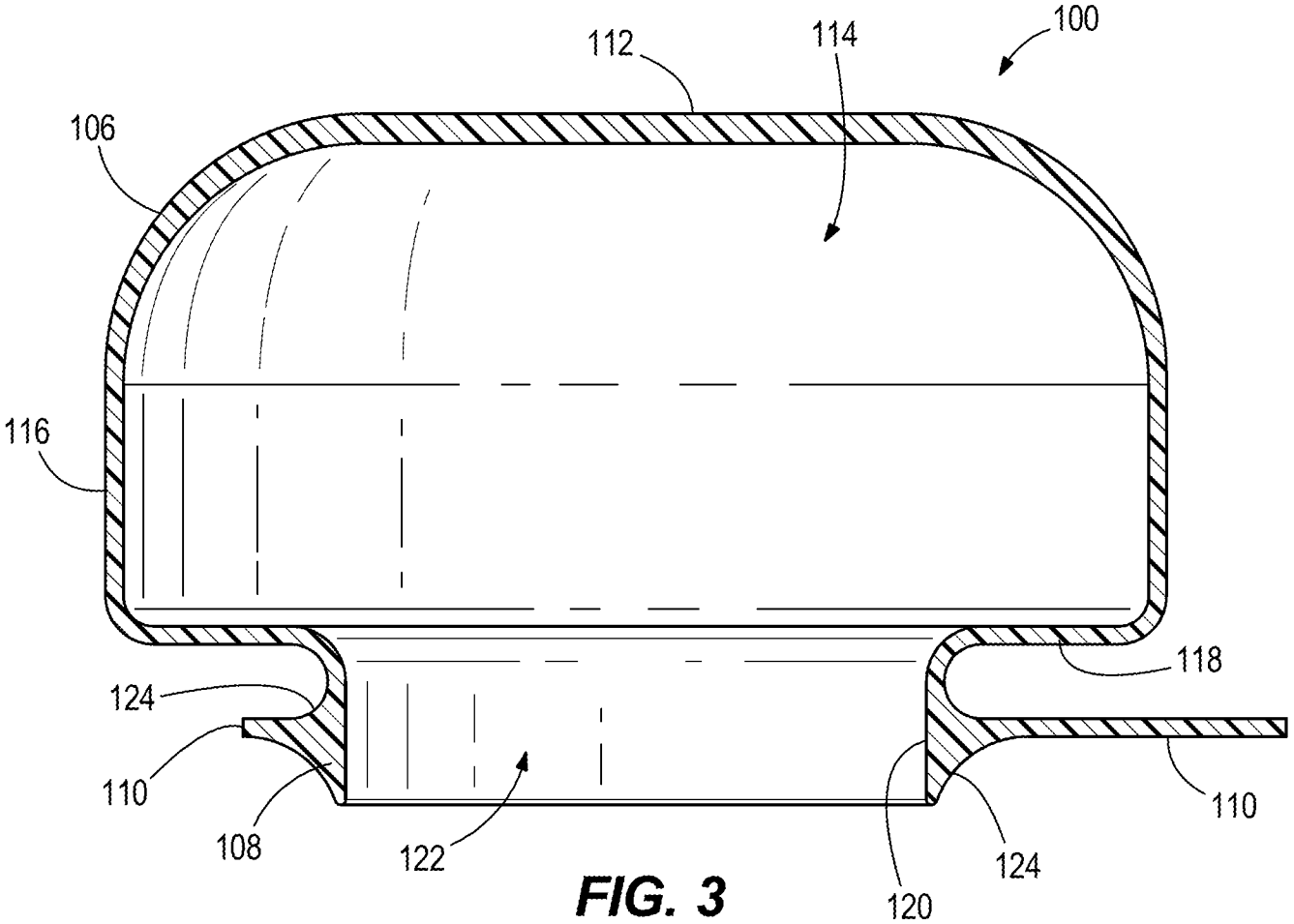
FIG. 3 is a cross-sectional elevation view of the masking device of FIG. 1.
Figure 4:
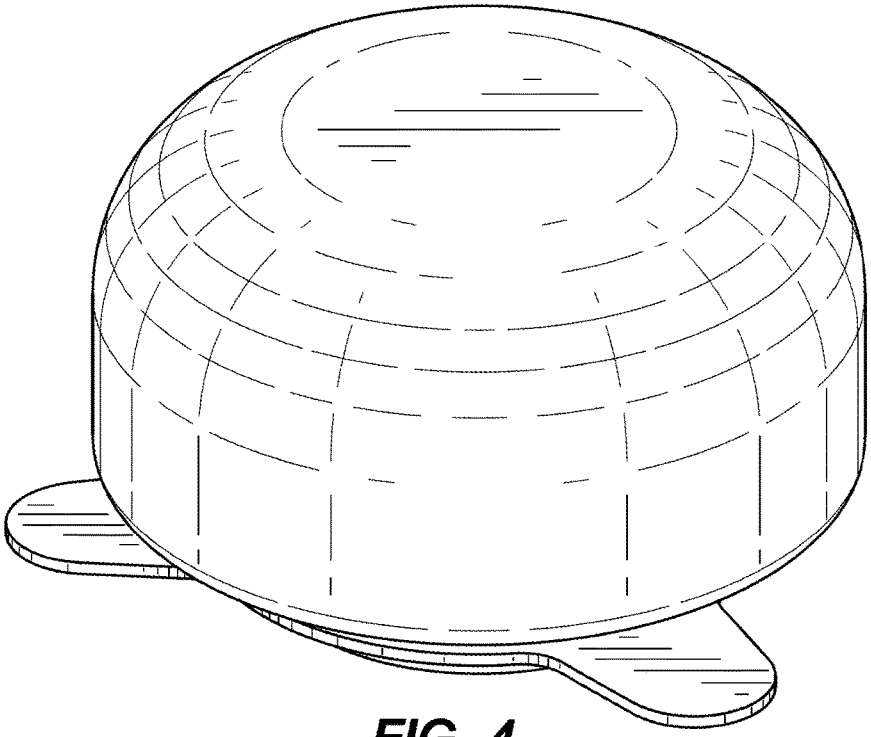
FIG. 4 is a top perspective view of the masking device of FIG. 1.
Figure 5:
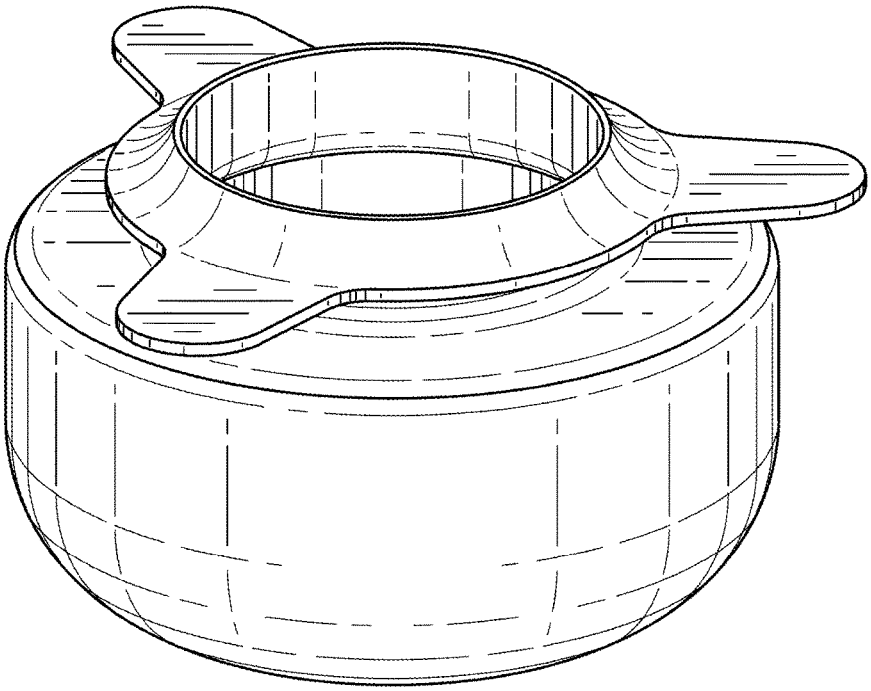
FIG. 5 is a bottom perspective view of the masking device of FIG. 1.
Figure 6:
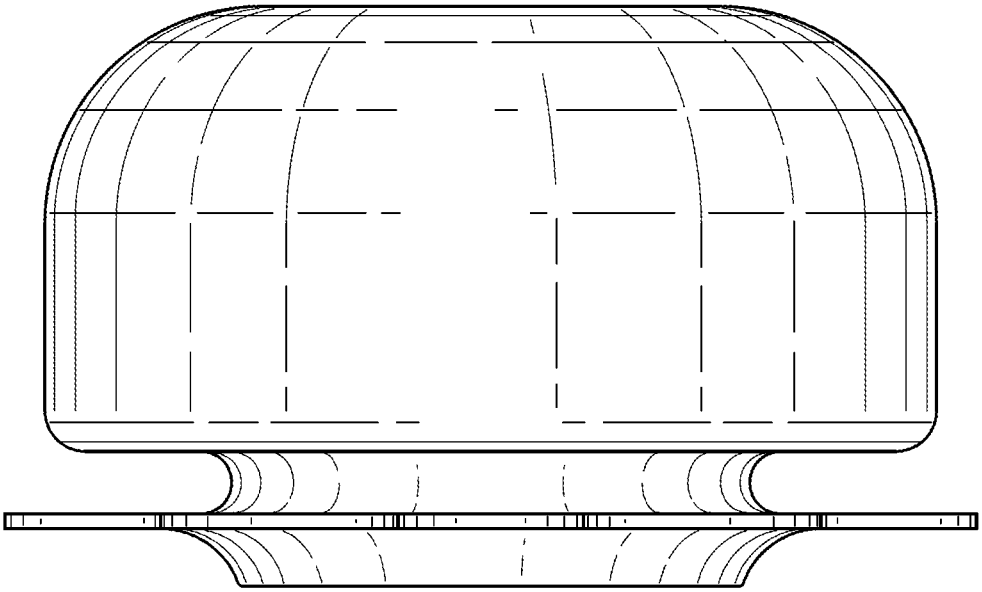
FIG. 6 is a front elevation view of the masking device of FIG. 1.
Figure 7:
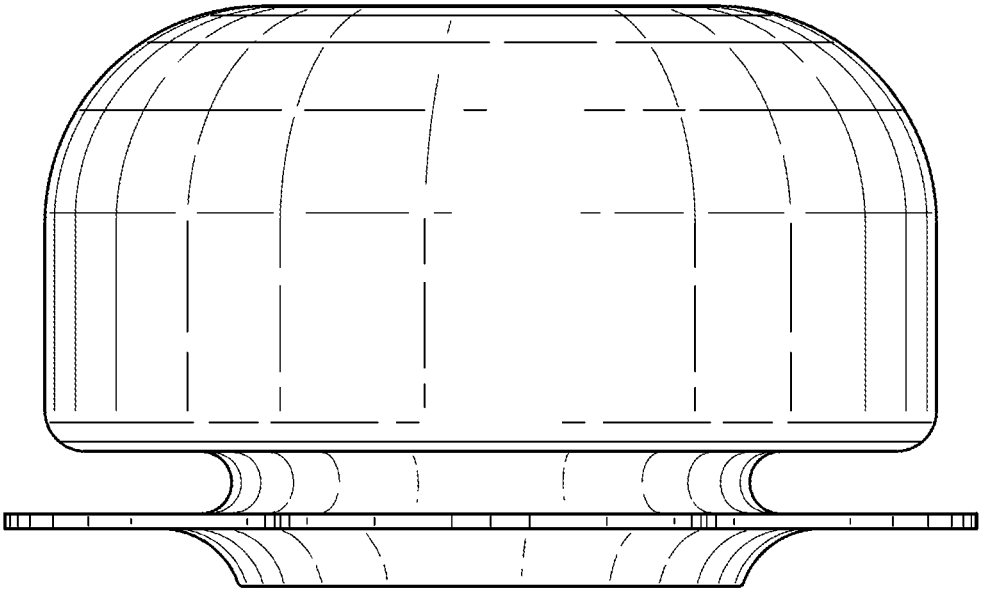
FIG. 7 is a rear elevation view of the masking device of FIG. 1.
Figure 8:
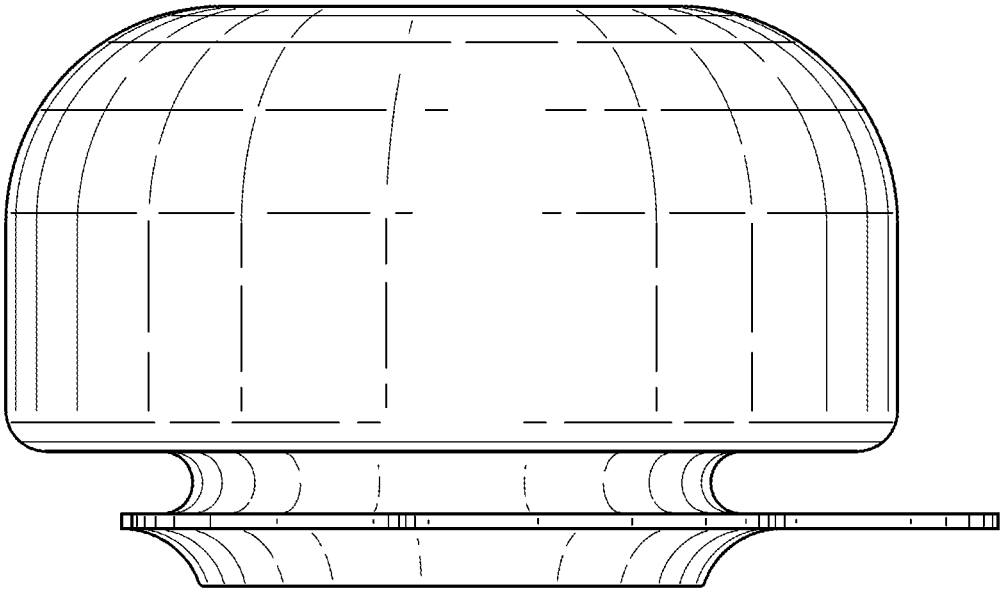
FIG. 8 is a right-side elevation view of the masking device of FIG. 1.
Figure 9:
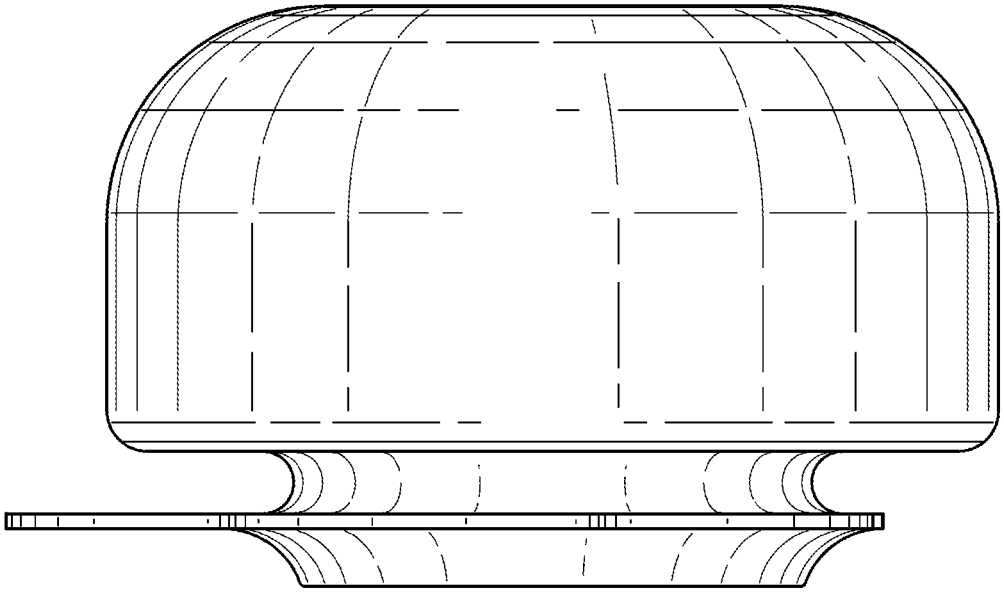
FIG. 9 is a left-side elevation view of the masking device of FIG. 1.
Figure 10:
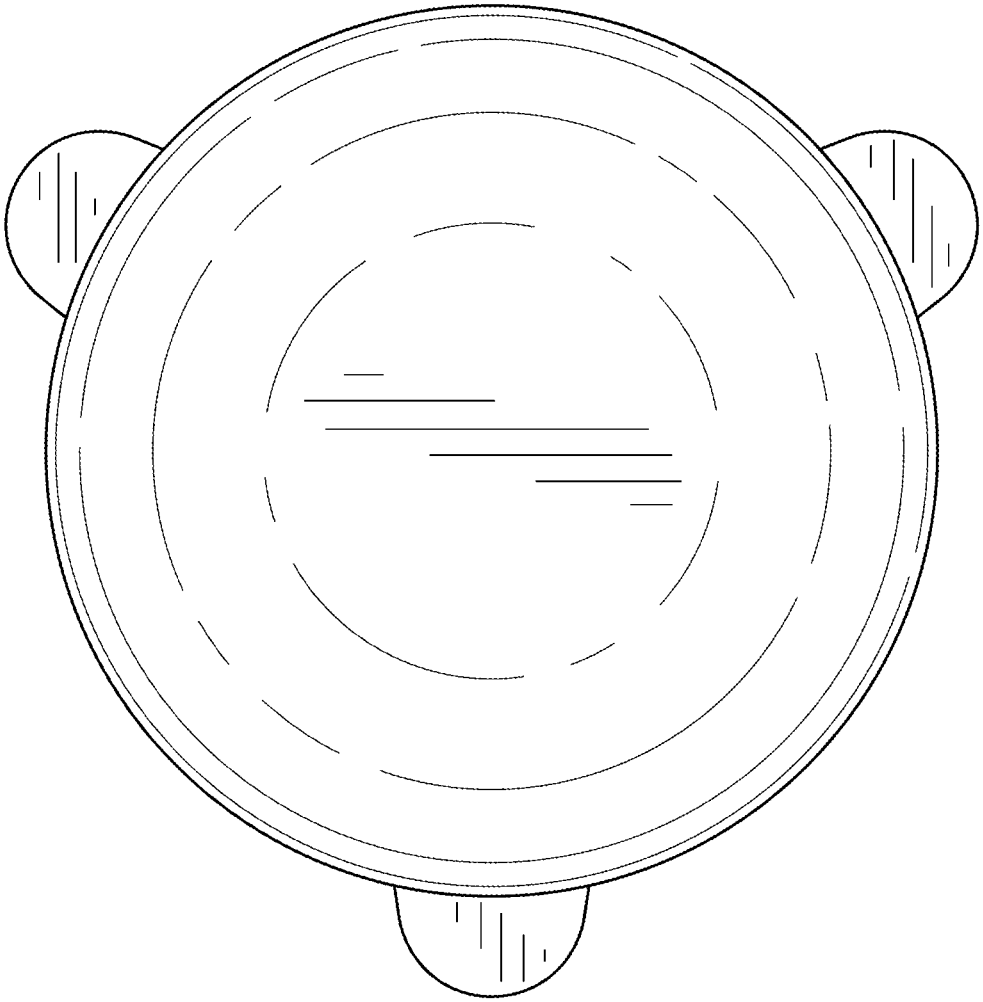
FIG. 10 is a top plan view of the masking device of FIG. 1.
Figure 11:
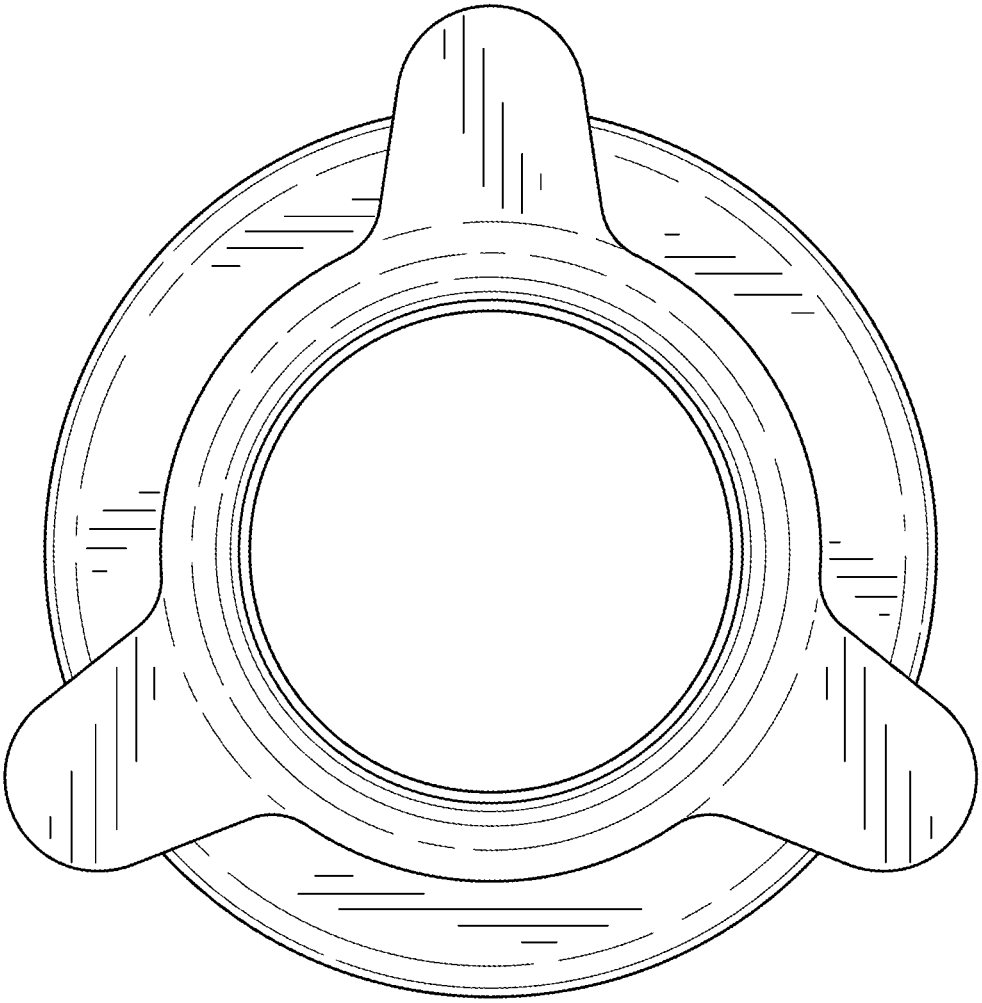
FIG. 11 is a bottom plan view of the masking device of FIG. 1.

As shown in FIGS. 1-3, the masking device 100 includes a head portion 106, a collar portion 108, and a plurality of pull tabs 110. In some embodiments, the head portion 106, the collar portion 108, and the pull tabs 110 are all integrally formed together as a unitary piece.

With particular reference to FIG. 3, the head portion 106 includes a closed end 112 and an interior cavity 114 defined in the head portion 106. The head portion 106 is illustrated as having a generally cylindrical shape with a rounded interface between the closed end 112 and the sidewall 116, but other embodiments may include the head portion 106 having other shapes. The head portion 106 further includes an annular wall 118 extending radially inwardly to meet the collar portion 108. In some embodiments, the closed end 112, the sidewall 116, and the annular wall 118 may all have the same or substantially similar wall thicknesses. Other embodiments, however, may include one or more portions having a thicker wall thickness than one or more other portions. For instance, the closed end 112 may have a wall thickness that is greater than the wall thickness of the sidewall 116 and the annular wall 118. These walls 112, 116, 118 are generally thin enough to be flexible when encountering a portion of the workpiece 104, so as to accommodate workpieces of varying sizes and shapes. In some embodiments, one or more of the walls 112, 116, 118 is between 0.04 inch (1.02 mm) and 0.1 inch (2.54 mm). In some embodiments, one or more of the walls 112, 116, 118 is between 0.05 inch (1.27 mm) and 0.09 inch (2.29 mm). In some embodiments, one or more of the walls 112, 116, 118 is between 0.06 inch (1.52 mm) and 0.08 inch (2.03 mm). The shape of the illustrated masking device 100 may also allow for masking a variety of workpieces having different sizes and shapes, given that the head portion 106 is larger/wider than the collar portion 108. Some embodiments provide for a standard masking device 100 instead of requiring many sizes or custom masking devices.

As shown in FIGS. 1 and 3, the collar portion 108 is coupled to the head portion 106. In the illustrated embodiment, the collar portion 108 is coupled to the annular wall 118 of the head portion 106 opposite the closed end 112 of the head portion 106. The collar portion 108 includes a radially inner surface 120 defining an opening 122. This opening 122 is in fluid communication with the interior cavity 114 of the head portion 106, such that an end 102 of the workpiece 104 can be inserted into the interior cavity 114 via the opening 122. As shown in FIG. 3, the opening 122 of the collar portion 108 is narrower than the interior cavity 114 of the head portion 106.

In some embodiments, the collar portion 108 is made of a flexible material such that a portion 102 of the workpiece 104 that is wider than the opening 122 can enter the interior cavity 114 by a user stretching the collar portion 108 so the portion 102 of the workpiece 104 may pass through the opening 122. In this manner, the collar portion 108 may tightly fit onto the workpiece 104 with the portion 102 of the workpiece 104 disposed in the interior cavity 114. In the illustrated embodiment, the radially inner surface 120 of the collar portion 108 has a constant diameter along its axis such that the opening 122 is circular.

Also shown in FIG. 3, the collar portion 108 includes a radially outer surface 124. The radially inner surface 120 and the radially outer surface 124 cooperate to form a cross-section of the collar portion 108 that is generally wedge-shaped in the illustrated embodiment. In these embodiments, this shape can be helpful in preventing aggressive spray or blasts of fluid (such as process wash, liquid spray application of paint or rust inhibitor, pressurized air, or the like) from entering the opening 122 and/or the interior cavity 114 while the masking device 100 is disposed on the workpiece 104. This feature is possible in these embodiments because the wedge-shaped cross-section may help avoid the aggressive spray or blasts of fluid achieving a mechanical advantage to move a part of the collar portion 108 relative to the workpiece 104. The wedge-shaped cross-section is oriented such that the cross-section of the collar portion 108 tapers in a radially outward direction. Stated another way, the widest portion of the wedge-shaped cross-section is formed by the radially inner surface 120 of the collar portion 108, and the radially outer surface 124 includes one or more sections that are acutely angled relative to the radially inner surface 120. Because of the irregular cross-section, the collar portion 108 has a wall thickness that is greater than a wall thickness of the head portion 106. Stated another way, at least one location of the collar portion 108 has a wall thickness that is greater than the wall thickness of one or more of the walls 112, 116, 118 of the head portion 106.

As shown in FIG. 1, the masking device 100 further includes at least one pull tab 110. The illustrated embodiment includes three pull tabs 110, but one, two, four, or more pull tabs 110 are also contemplated herein. The three illustrated pull tabs 110 are spaced evenly circumferentially about the collar portion 108, but other embodiments may include pull tabs 110 that are unevenly spaced. The pull tabs 110 are coupled to the radially outer surface 124 of the collar portion 108. In the illustrated embodiment, the pull tabs 110 are coupled by virtue of being integrally formed as a single piece with the collar portion 108 at the radially outer surface 124 of the collar portion 108. Each of the pull tabs 110 extends radially outwardly from the collar portion 108 beyond the radially outermost sidewall 116 of the head portion 106. In the illustrated embodiment, the pull tabs 110 are positioned on the radially outer surface 124 of the collar portion 108 such that in cross-section, the collar portion 108 tapers toward the pull tab 110. Stated another way, each pull tab 110 is positioned at or around a tip of the wedge-shaped cross-section of the collar portion 108 opposite the radially inner surface 120.

To use the masking device 100, a user positions the opening 122 of the collar portion 108 on or adjacent to a portion of the workpiece 104. The user pulls at least one of the pull tabs 110 radially outwardly to widen the opening 122. Widening the opening 122 allows for the relatively wider portion of the workpiece 104 to at least partially pass through the opening 122. The user may need to pull a different pull tab 110 simultaneously or subsequently to the first pull tab 110 to further pass the portion of the workpiece 104 through the opening 122. Once the user has sufficiently pulled the pull tabs 110 to widen the opening 122 and to pull the masking device 100 farther onto the workpiece 104, the user then releases the pull tabs 110. The opening 122 of the collar portion 108 is biased toward its relaxed state, given it is made of an elastic or resilient material. If the section of the workpiece 104 occupying the opening 122 is wider than the opening 122, the collar portion 108 contacts the workpiece 104 to seal the masking area 102 of the workpiece 104 from the outside environment. This arrangement allows for aggressive spray or blasts of fluid (such as process wash, liquid spray application of paint or rust inhibitor, pressurized air, or the like) to be utilized in washing, treating, coating, or the like of the exposed portions of the workpiece 104 without allowing leakage of these fluids onto the masking area 102 of the workpiece 104. In embodiments including the masking device 100 made of a heat resistant material, the workpiece 104 along with the masking device 100 disposed thereon may be placed in an oven or otherwise heat treated if necessary (e.g. for curing, drying, or the like).

The above discussion should not be taken as limiting with regard to the current disclosure. Multiple possible embodiments not explicitly discussed herein are contemplated with this disclosure. Features from one embodiment may replace or supplement features from another embodiment to form still another embodiment. Other changes, additions, and/or subtractions to the designs discussed herein are also contemplated.

What is claimed is:

1. A masking device for placement over an end of a work piece, the masking device comprising:

a head portion including a closed end and an interior cavity defined in the head portion;

a collar portion coupled to the head portion opposite the closed end of the head portion, the collar portion including a radially inner surface defining an opening at an open end of the collar portion, the opening being in fluid communication with the interior cavity of the head portion, the opening being narrower than the interior cavity of the head portion, the collar portion further including a radially outer surface, the collar portion terminating distally from the head portion at the open end; and at least one pull tab coupled to the radially outer surface of the collar portion, the at least one pull tab extending longitudinally and radially outwardly from the collar portion at a position between the head portion and the open end of the collar portion.

2. The masking device of claim 1, wherein the at least one pull tab extends radially outwardly from the collar portion beyond the head portion.

3. The masking device of claim 1, wherein the at least one pull tab includes three pull tabs.

4. The masking device of claim 3, wherein the three pull tabs are evenly circumferentially spaced about the collar portion.

5. The masking device of claim 1, wherein the masking device is made of silicone rubber.

6. The masking device of claim 1, wherein a wall thickness of the collar portion is greater than a wall thickness of the head portion.

7. The masking device of claim 1, wherein the head portion, the collar portion, and the at least one pull tab are integrally formed together as a unitary piece.

8. The masking device of claim 1, wherein the collar portion further includes a cross-section shaped such that the collar portion tapers toward the at least one pull tab.

9. The masking device of claim 1, wherein the radially inner surface of the collar portion has a constant diameter along its axis such that the opening is circular.

10. The masking device of claim 1, wherein the head portion further includes an annular wall, the annular wall extends radially inward toward the collar portion, the at least one pull tab is parallel to the annular wall, a wall thickness of the collar portion is greater than a wall thickness of the annular wall, a wall thickness of the closed end is greater than the wall thickness of the annular wall, and the annular wall has a thickness between 0.04 inches and 0.1 inches.

11. The masking device of claim 8, wherein the cross-section of the collar portion is in a shape of a wedge defined between the radially inner surface and the radially outer surface, the widest portion of the wedge being the radially inner surface of the collar portion.

12. The masking device of claim 1, wherein the masking device is elastic such that the collar portion stretches to widen the opening.

* * * * *